United States Patent [19]

Koike et al.

[11] Patent Number: 4,629,504

[45] Date of Patent: Dec. 16, 1986

[54] STEEL MATERIALS FOR WELDED STRUCTURES

[75] Inventors: Makoto Koike, Tokyo; Hiroyuki Honma; Shoichi Matsuda, both of Kanagawa; Masana Imagunbai, Chiba; Masazumi Hirai, Chiba; Fukuyoshi Yamaguchi, Chiba, all of Japan

[73] Assignee: Nippon Steel Corporation, Tokyo, Japan

[21] Appl. No.: 780,632

[22] Filed: Sep. 26, 1985

[30] Foreign Application Priority Data

Sep. 28, 1984 [JP] Japan ..... 59-203099

[51] Int. Cl.[4] ..... C22C 38/14

[52] U.S. Cl. ..... 420/38; 148/129; 164/56.1; 164/57.1; 420/75; 420/91; 420/99; 420/118

[58] Field of Search ..... 75/123 M, 126 D, 128 T, 75/58, 129, 56, 123 R, 126 R, 128 R; 148/36, 2, 12 R, 12 F; 164/57.1, 56.1

[56] References Cited

U.S. PATENT DOCUMENTS

| | | | |
|---|---|---|---|
| 1,019,526 | 3/1912 | Rossi | 75/123 M |
| 1,104,317 | 4/1914 | Rossi | 75/123 M |
| 3,765,874 | 10/1973 | Elias et al. | 148/36 |
| 4,331,488 | 5/1982 | Sudo et al. | 148/36 |
| 4,491,476 | 11/1985 | Tada et al. | 148/36 |

FOREIGN PATENT DOCUMENTS

| | | |
|---|---|---|
| 50-80911 | 8/1975 | Japan . |
| 51-16890 | 4/1976 | Japan . |
| 58-204118 | 6/1983 | Japan . |
| 58-204117 | 8/1983 | Japan . |
| 58-204116 | 11/1983 | Japan . |

*Primary Examiner*—L. Dewayne Rutledge
*Assistant Examiner*—Deborah Yee
*Attorney, Agent, or Firm*—Cushman, Darby & Cushman

[57] ABSTRACT

Production of steel materials which show excellent HAZ qualities when used for welded structures and contain C: 0.001 to 0.300%
Mn: 0.4 to 2.0%
P: 0.025% max.
S: 0.025% max.
Al: 0.007% max.
Ti: 0.003 to 0.050%
O: 0.0010 to 0.0100%

Balance: iron and unavoidable impurities and containing 0.002 to 0.100% of oxide inclusion having a complex grain phase composed of one or more of Ti oxides such as TiO, $Ti_2O_3$ having a particle size of not larger than 10 μm.

14 Claims, 5 Drawing Figures

PRESENT STEEL 50μm

CONVENTIONAL KILLED STEEL 50μm

STEEL MATERIALS FOR WELDED STRUCTURES

FIELD OF THE INVENTION AND RELATED ART STATEMENT

The present invention relates to welding structural steels, and more particularly to production process of steel materials which, when used as welded structures, are less susceptible to initiation and propagation of brittle cracks in the heat affected zone (herein called HAZ) in the welded joints. More specifically, the present invention is mainly directed to steel materials which are required to satisfy severe demands with respect to Charpy notch toughness in HAZ welded with large-heat-inputs, and with respect to COD values in HAZ welded by ordinary welding.

In case of steel materials which are designated for welding, represented by so-called "welding structural steels", it is generally very difficult to retain various properties of the steel materials in the HAZ after fabrication of steel structure. Specifically, it has been very often experienced that notch toughness and COD value, and further properties favorable to prevention of initiation and propagation of brittle fractures are much deteriorated in HAZ as compared with the properties in the parent material which is not affected by the welding heat.

Cause of the deteriorations in the above-mentioned properties is attributed to the facts that the microstructures in HAZ is coarsened by the welding heat, and that such structure is formed in HAZ which is quite susceptible to hydrogen delayed cracks caused by hydrogen supplied by the deposited metal. Therefore, from the view-point of assuring safety of welded structures against brittle fracture, it has been regarded very important to elevate fracture toughness in HAZ and to prevent hydrogen delayed cracks.

Under the above situation, in order to compensate the embrittlement in HAZ, conventional practice exercised by suppliers of such steel materials has been directed not only to remarkable enhancement of the low temperature toughness of parent steel materials, but also to application of some treatments which can reduce the embrittlement in HAZ. For example, even in applications of ordinary carbon-manganese steel which is satisfactorily used as far as the properties of parent materials are concerned, various proposals and trials have been made from the view-point mentioned above. They include, for instance, a method to lower carbon contents with addition elements such as Ni, Cu, Mo, Nb and V. For the purpose of preventing excessive growth of the grains in HAZ of such steel, fine dispersion of nitride particles such as TiN into the steel, and fine dispersion of such inclusions as oxides and sulfides of REM into the steel are preferable to minimize the embrittlement in HAZ. For example, Japanese Patent Publication Sho 51-16890 and Japanese Laid-Open Patent Application Sho 50-80911 disclose the art of preventing the excessive growth of grains in the HAZ, and Japanese Laid-Open Patent Applications Sho 58-204115, Sho 58-204116, Sho 58-204117 and Sho 58-204118 disclose the art of reducing the embrittlement in the HAZ.

Despite the above-mentioned endeavors and counter measures taken by steel suppliers, the following problems remain still unsolved. Thus in the art utilizing nitrides like TiN, no effective prevention of excessive growth of grains by welding heat can be achieved, because nitrides are dissolved in the high temperature portion of HAZ (herein called the high temperature HAZ portion) where the maximum temperature can exceed about 1350° C. For this reason, in the high temperature HAZ portion, coarse structures such as coarse bainite structures (herein called coarse Bu) and ferrite side plate (herein called FSP) mingle together, consequently no improvement of the COD value of HAZ can be obtained. The same can be said to the conventional art utilizing complex precipitates of nitrides and MnS.

Also the art utilizing oxides and sulfides of REM has its own problem. Because $Al_2O_3$-oxides and sulfides tend to be combined with each other to form larger inclusions in Al-killed steels, and this adverse effect of REM is very difficult to be eliminated particularly in manufacturing processes including continuous casting process which nowadays constitutes the most important process for steel plates. In addition, oxides and sulfides of REM appearing in Al-killed steels are stable in the high temperature HAZ portion. They remain to be effective in preventing the growth of austenite grains, but the resultant austenite grains are generally too coarse to suppress the development of Bu and FSP which deteriorate the toughness of HAZ.

On the other hand, despite demands for economical fabrication method in the construction of welded steel structures, preheating and post-welded heat treatments and restriction of the upper limit of welding heat-input, all being contradictory factors against the economical demands, have been actually practised so as to minimize the embrittlement in HAZ and thereby prevent such defects as hydrogen-delayed cracks in the embrittled portion in HAZ. These difficulties, however, have not been solved successfully. It means that no effective method has been proposed in eliminating the formation of brittle microstructures such as coarse Bu and FSP as far as the conventional steel materials are concerned. Therefore these methods do not perfectly remove the possibility of brittle fracture of steel structures, when one of the cracks such as fatigue crack, stress corrosion crack and hydrogen induced crack, each generated and extented under service conditions, reaches the above mentioned embrittled microstructure-zone.

OBJECT AND SUMMARY OF THE INVENTION

Therefore the present invention is to provide steel materials free from the formation of coarse Bu and FSP in the HAZ, which induce the brittle fractures in welded steel structures. Thereby the present invention aims at remarkable improvements of the Charpy notch toughness of the HAZ as compared with the conventional steel and simultaneously aims at great enhancement of the COD characteristics.

It is another object of the present invention to improve resistivity against cold cracking in the HAZ of welded structures by completely different means from the conventional means which are ordinarily based on lowering of carbon contents and/or Ceq and Pcm. Thus the conventional art of lowering carbon contents, Ceq and Pcm requires the addition of strengthening elements such as Mn, Cu, Ni, Mo, Nb, V and B so as to compensate the lowering of strength of the steel material by the lowered carbon content, Ceq and Pcm. The addition of these elements increases the production cost of the steel materials as well as difficulties in refining of molten steel, and it also does not escape from segregation problems and deteriorations in surface quality of casting slabs (particularly continuous cast slabs), which greatly deteriorates efficiency in production and economical manufacturing of steel plates. Additionally, the conventional art has been found not to be always effective to achieve the desired improvement on the cold cracking in HAZ.

In order to determine the conditions which can prevent the formation of microstructures such as coarse Bu and FSP which weaken the resistance of the HAZ to brittle crack. The formation of coarse and hardened microstructures, such as coarse Bu, helps hydrogen-delayed cracks develop easily in the HAZ under various welding conditions commonly adopted in commercial production practices. The present inventors conducted extensive and systematic investigations of the transformation behaviours of the HAZ and found that steels containing fine Ti oxide particles mainly consisting of lower oxides of Ti, and containing no Al are best suited to the above purposes. Thus it has been found that in the steels just above mentioned, transformation mechanism from austenite phase to bainite phase in the HAZ is different from that in conventional steels. In the transformation, ferrite plates develop from finely dispersed oxide particles which play as the transformation nuclei within austenite grains, resulting in a bainitic microstructure in which the ferrite plates develop along the three equivalent (100) planes of the austenite phase so that the undesirable microstructures, such as coarse Bu, FSP and other coarse and hard microstructures can be suppressed.

DETAILED DESCRIPTION OF THE INVENTION

The present invention will be described in more details with reference to the accompanying drawings.

Figure 1A:
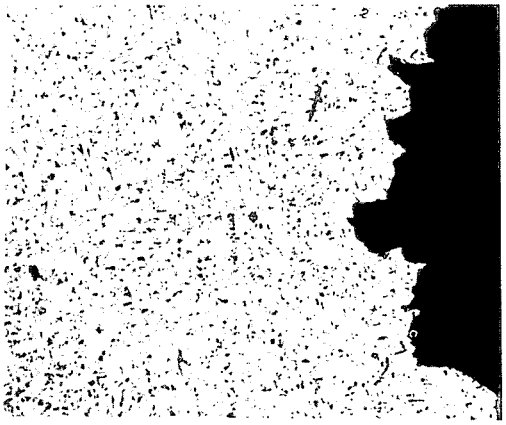
FIGS. 1(*a*) and 1 (*b*) show the difference in unit size of cleavage, or effective grain size in the micrographs observed at the initiation point of brittle crack in a Charpy specimen after a HAZ-simulating thermal cycle test of the present steel and a conventional steel respectively.
Figure 1B:
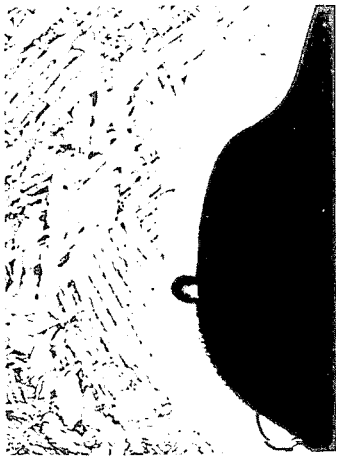

In the case of steels having a very low Al content and containing Ti oxides including one or two of crystal phases of Tio, $Ti_2O_3$ etc., a bainitic microstructure consisting of ferrite plates of Widmannstätten structure is formed in the HAZ as shown in FIG. 1(*a*). This bainitic microstructure will not be formed as the Al content in steel increases to a higher level. In that case, another type of bainitic microstructures is formed. The ferrite plates of the bainitic microstructures grow predominantly along with one of the three equivalent (100) planes of the original austenite as seen in FIG. 1(*b*). This bainite structure is herein called "FSP".

The present invention has been completed on the above discoveries and has its main object to provide a process for producing steel materials which show improved Charpy notch toughness and COD property when welded, particularly with large heat-input weldings. The steels by the present invention are less susceptible to cold cracking by way of refinement of the microstructure in welded HAZ through the special transformation behaviour from austenite to bainite.

Thus the process for producing steel materials which show excellent toughness in the HAZ according to the present invention comprises adding titanium to a molten steel containing not more than 0.020% of dissolved oxygen, not more than 0.007% of aluminum and not more than 0.05% of silicon all of which are unavoidably introduced during the treatment of molten steel, and casting the molten steel thus deoxidized and/or rolling. The product thus obtained contains:

C: 0.001 to 0.300%
Mn: 0.4 to 2.0%
P: 0.025% max.
S: 0.025% max.
Al: 0.007% max.
Ti: 0.003 to 0.050%
O: 0.0010 to 0.0100%

Balance: iron and unavoidable impurities and containing 0.002 to 0.100% of oxide inclusion having a complex grain phase composed of one or more of Ti oxides such as TiO and $Ti_2O_3$ having a particle size of not larger than 10 μm. The cast product may be further rolled.

A modification of the final product obtained by the present invention may further contain one or more of Si, Cu, Ni, Cr, Mo, Nb, V, B, Zr, Ta, W, Co, and Ca in an amount:

Si: 0.8% max.
Cu: 1.5% max.
Ni: 10% max.
Cr: 1% max.
Mo: 1% max.
Nb: 0.2% max
V: 0.5% max.
B: 0.005% max.
Zn: 0.1% max.
Ta: 0.1% max
W: 0.1% max.
Co: 0.1% max.
Ca: 0.002% max.

The basic composition of the steel material according to the present invention is as defined above and the reasons for defining the composition will be explained below.

Certain amounts of C and Mn are necessary for giving the steel enough strength, but on the other hand excessive addition of these elements should be avoided since they promote hardening of HAZ. For these reasons the steel material according to the present invention should contain 0.001 to 0.300% C and 0.4 to 2.0% Mn.

Regarding the elements, P, S, and N, they do not have primary significance to the technical features of the present invention, however, they should be preferably maintained as low as possible. P and S should be not are than 0.025% respectively and N should be not more than 0.0040%.

Al, Si, Ti and O participate in the basic mechanism for the formation of the fine bainite structure composed of ferrite plates of Widmannstätten-like form ( hereinafter called fine bainite structure) in the HAZ. With Al contents higher than 0.007%, the fine bainite structure will not appear for the reason that the oxides containing the complex grain phase of one or more of titanium oxides such as TiO and $Ti_2O_3$ which control the formation of the Widmannstätten-like ferrite plates composing the fine bainite structure are reduced by Al into oxides which are no more able to form the "fine bainite structure", so that the desired result of the present invention will not be achieved. Therefore it is necessary that Al is neither added nor allowed to be contained exceeding an amount required to keep the necessary amount of dissolved oxygen in the molten steel prior to addition of titanium. In that sense it is necessary to prevent the contamination of Al into the steel from ferro-alloys and refractories. In the present invention the Al content unavoidably contaminated into the molten steel as impurity is maintained not more than 0.007%. To obtain a sufficient amount of Ti oxides in the steel to enhance the desired result of the present invention, the Al content should preferably be maintained not larger than 0.005%.

Similar considerations should be made regarding Si content. Thus it is desired that no silicon is present in the molten steel prior to the addition of titanium because it lowers the content of oxygen dissolved in the molten steel prior to the addition of tiatnium. However Si has a less affinity with oxygen in the molten steel as compared with Al, and if added after the addition of titanium it will not deteriorate the result of the present invention. For these reasons the addition of Si prior to the addition of Ti is prefereably not more than 0.05% and the Si content, if added after the addition of Ti, may be in the same range as seen in ordinary welding structural steels and may be present up to 0.8%.

Ti and O directly participate in the formation of the above Ti oxides, and if their contents are excessively low an appropriate amount of Ti oxides cannot be formed, and on the other hand if excessively high, the Ti oxides coagulate and grow coarse so that the desired result of the present invention will not be obtained. For assuring desired contents of the dissolved oxygen in the molten steel, it is preferable to perform a preliminary deoxidation of the molten steel by means of vacuum degassing and/or a small addition of deoxidizers such as Si and it is necessary to maintain the content of dissolved oxygen in the molten steel not more than 0.020% prior to the addition of Ti for deoxidation. It is necessary that the final contents of Ti and O attained by the cleaning of the molten steel deoxidized by addition of Ti under stirring or using inert gas should be maintained in the range from 0.003 to 0.050% for Ti and from 0.0010 to 0.0100% for O and the cleaning process by stirring or inert gas is stopped at this stage. If the cleaning of the molten steel is not enough and the O content exceeds 0.0100%, the resultant Ti oxides are coarse and the desired fine bainite structure of the present invention will not be produced, instead they tend to be the cause of surface defects in the final products due to the coarse inclusions. On the other hand, if the O content is less than 0.0010%, the amount of above oxides is not enough. Also if the Ti content is less than 0.003%, the amount of the above oxides is not enough, and if it exceeds 0.050%, an excessive amount of TiO is formed, which will deteriorate the toughness in the HAZ.

Further explanation will be made for the elements which are preferably added according to the present invention.

Cu and Ni are both effective to increase the strength and toughness of the steel materials, with less harm on the cold toughness of the HAZ and are added for these purposes in amounts not more than 1.5% Cu and not more than 10% Ni, beyond which they can not produce any technical contribution to the desired results of the present invention.

Cr, Mo, Nb, and V are effective to enhance the hardening property of the steel and to increase the strength through precipitation hardening as they precipitate in the form of carbo-nitrides. Further, if applied to an appropriate manufacturing process, they are expected to improve the low temperature toughness of the steel. However, these elements, when added in excessive amounts, cause the hardening of the HAZ, hence greater tendency of cold cracking of the weld. Therefore, Cr and Mo should be maintained not more than 1% respectively and Nb should be not more than 0.2% and V should be not more than 0.5%.

B contributes to improvement of the hardenablity of the steel in the quenching treatment and to the increase of nuclei for the ferrite transformation in a controlled rolling process, hence effective to refine the ferrite-pearlite structure. For this purpose B is added in an amount no more than 0.0050%.

Zr, Ta, W and Co may be added in an amount hot more than 0.1% respectively for the purpose of improving the corrosion behaviour of the steel.

Ca is added for controlling the shape of MnS, but excessive amounts of Ca will cause reduction of the titanium oxides, thus producing detrimental effects on the desired results of the present invention. Therefor Ca should be added in amounts not more than 0.0020%.

In the process according to the present invention, it is preferable to maintain a protective atmosphere of inert gas, such as argon gas for the molten steel prior to the addition of Ti, specifically in a closed vessel such as RH, DH, and VAD, or cover the surface of the molten bath with inert gas for the purpose of preventing loss of the added Ti through oxidation by oxygen in atmosphere during the stirring of the molten steel, and for this purpose it is also desirable to maintain the partial pressure of oxygen in the protective atmosphere not higher than 10 Torr.

In the present invention, when a molten steel containing only a weak deoxidizing element and 5 to 60 ppm oxygen dissolved therein, substantially free from primary deoxidation products, is cast with a cooling rate of 20 to 400° C./min. for solidification, it is possible to uniformly disperse fine secondary deoxidation products, if formed; hence further advantage for the improvement of the HAZ thoughness, can be obtained.

The steel material produced according to the present invention may be as-cast, as hot-rolled, or heat-treated following the casting or hot rolling.

The transformation behaviour of the steel material according to the present invention will be described in comparison with that of conventional steel materials.

(A) Conventional Steel Materials

In the conventional ordinary Si-Al killed steel ( herein called conventional killed steels ) the structure of the HAZ changes depending on the maximum temperature and the cooling rate at which the transformation from the austenite phase begins. This fact can be illustrated by the CCT diagram.

Figure 3:
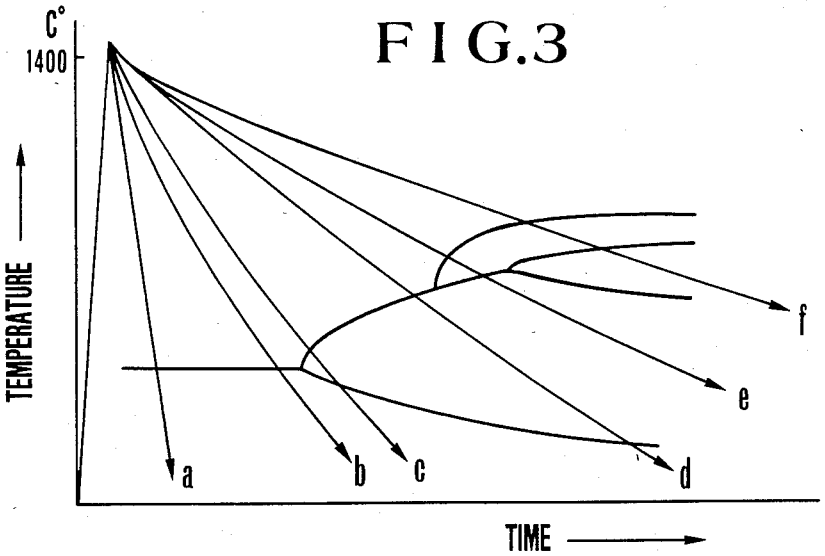
FIG. 3 shows schematically the formation of microstructures after HAZ-simulating thermal cycle test of the conventional killed steel.
Figure 3:
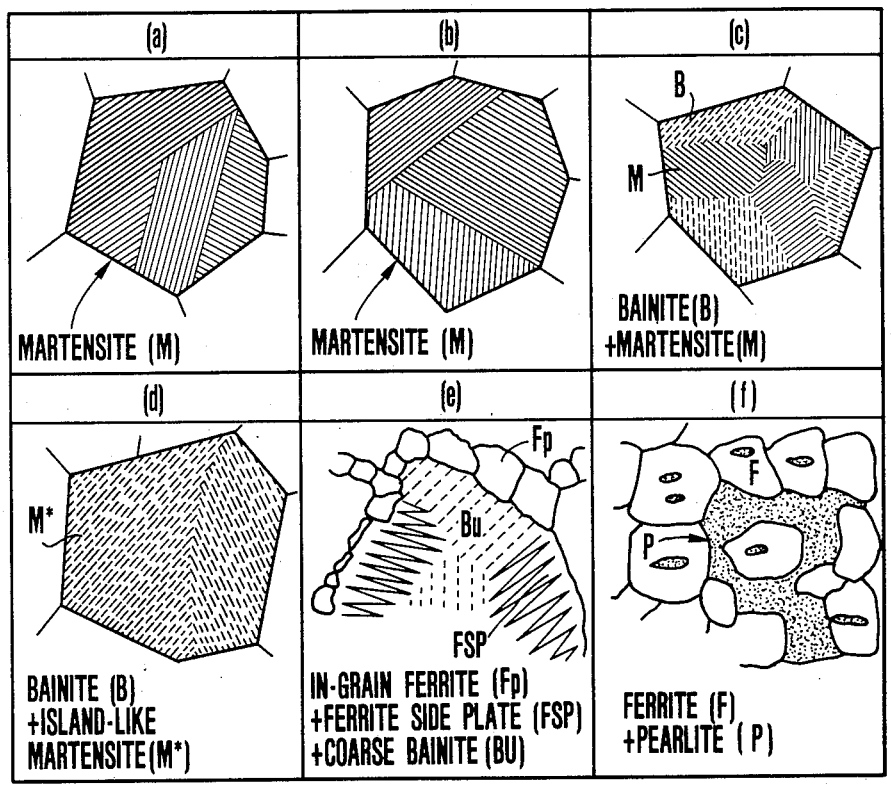

FIG. 3 shows schematically the structure of the conventional killed steel when it is heated to a temperature of 1400° C. or higher with a simulating thermal cycle and cooled at various cooling rates. Needless to say the heat cycles shown simulate the heat cycle of the portions of the HAZ adjacent to the weld metal. As shown in FIG. 3, at higher cooling rates a and b, the martensite transformation appears predominantly in the resultant microstructures (a) and (b), and at a lower cooling rate f, the ferrite-pearlite transformation appears predominantly in the resultant microstructure (f). In actual high temperature HAZ produced by intermediate cooling rates like c, d and e, these microstructures are seldom seen and the microstructure will be like the microstructures as shown (c), (d) and (e). The microstructures (c) and (d) are mixed structures of martensite and bainite, very susceptible to the occurrence and development of hydrogen delayed cracks. The structure (e) contains ferrite at the grain boundaries mixed with FSP and Bu, thus having as poor resistance to the brittle fracture as the structure (c).

(B) The transformation behaviour of the HAZ of the steel according to the present invention will be described.

As compared with the conventional killed steels as mentioned above, the present steel shows a completely different transformation behaviour at the cooling rates corresponding to those of the structures (c), (d) and (e) in FIG. 3.

Figure 2A:
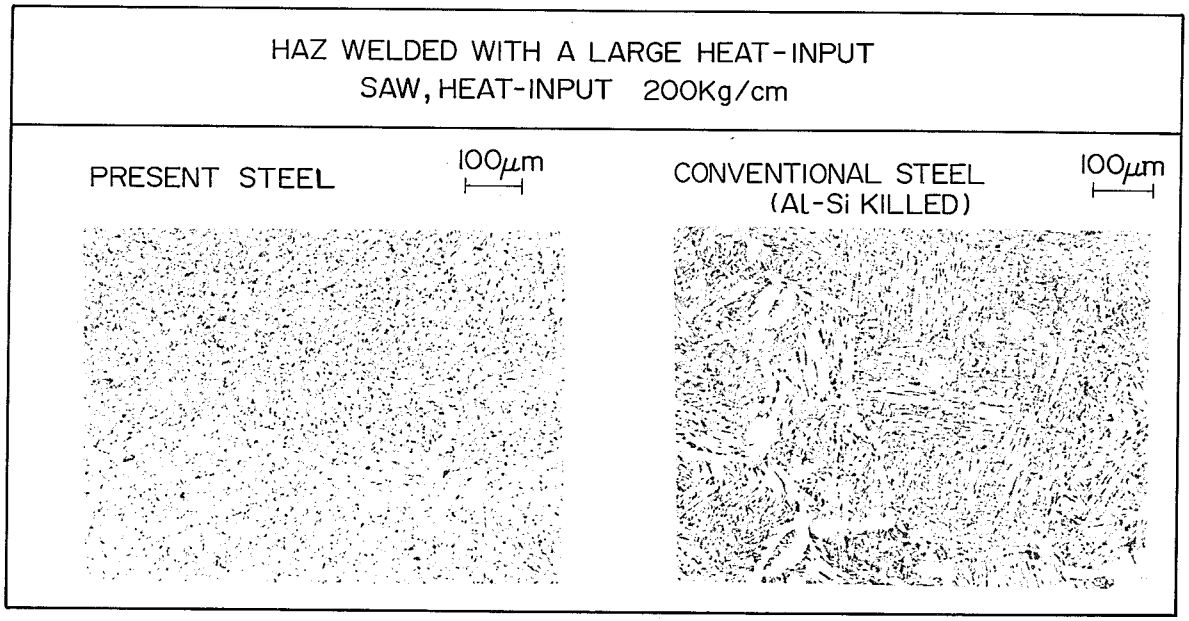
FIGS. 2(*a*) and 2 (*b*) show the micrographs of HAZ of large heat input weld and a small heat-input weld of the present invention in comparison with a conventional steel.
Figure 2B:
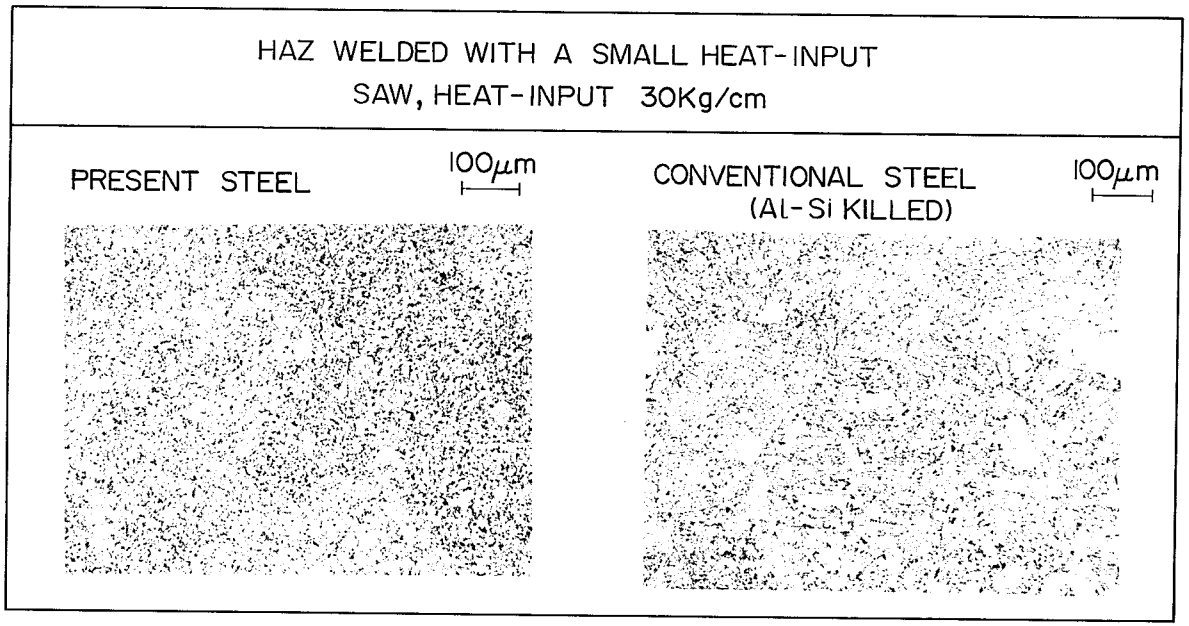

Thus in the case of the steel of the present invention, in the high temperature HAZ portion, the "fine bainite structure" accompanying no grain boundary ferrite is formed when welded with a small heat-input as shown in FIG. 2(*b*). Although some grain boundary ferrites are seen as shown in FIG. 2(*a*) when a large heat-input welding is applied, a similar "fine bainite structure" can be obtained as in the case of the small heat-input welding.

The reason for the formation of the "fine bainite structure" in the HAZ of the steel according to the present invention is that the ferrite plates develop along the three equivalent crystal planes (100)(010)(001) of the $\gamma$ phase during the transformation from austenite to bainite to form the Widmannstätten structure. For the formation of the structure, it is necessary that the Al content in the steel material is low and there must be present Ti oxides including one or more crystal phases of TiO, $Ti_2O_3$, etc. If the deoxidation with Al is performed prior to the addition of Ti, or if Al is added after the addition of Ti, the amount of the desired Ti oxides is decreased or reduced so that the desired result of the present invention cannot be obtained.

As understood from the above explanation, the present invention is completely different from the conventional art involving the TiN treatment of Al-Si killed steels and also completely different from the conventional art of forming a structure mainly composed of fine ferrite and bainite in the HAZ of a large heat-input welding by adding successively into the molten steel Mn, Si with Ti or Al, REM or Ca from a weak deoxidizer to a strong one according to the deoxidizing power, to uniformly disperse fine inclusions so as to form fine precipitates of nitrides, such as TiN and BN.

(C) The brittle fracture of the steel according to the present invention will be explained in comparison with that of the conventional steels.

In the case of the steel according to the present invention, the HAZ will have a microstructure as shown in FIG. 2. The microstructure is a fine acicular ferrite structure so that the cleavage unit of brittle fracture in the HAZ is remarkably small compared with that of the conventional steel. FIG. 1(*a*) shows the brittle fracture of the high temperature HAZ portion of the steel according to the present invention and FIG. 1(*b*) shows the brittle fracture in a similar HAZ portion of the conventional steel (Al-Si killed). From the comparison of these fractures, it is seen that the brittle cracks in the HAZ of the steel of the present invention is finer and this finer cleavage unit of fracture gives far better Charpy notch toughness, COD characteristics, and resistance to cold cracking compared with those of the conventional steels.

DESCRIPTION OF THE PREFERRED EMBODIMENTS

The present invention will be better understood from the following description of the preferred embodiments.

EXAMPLE 1

In Table 1, the production conditions, properties of the steels according to the present invention are shown together with the transformation structures after various fusion simulating thermal cycles and the results of Charpy impact tests, in comparison with the conventional killed steel.

The steel compositions of the present invention are represented by HT50 steel which is widely used in marine structures and ships while the corresponding steel by a conventional process is treated with TiN (TiN treatment is most commonly accepted as a technic for preventing the coarsening of grains).

As understood from Table 1, in the transformation structure after the simulating thermal cycle with a maximum temperature not lower than 1400° C., the undesired structures such as FSP and coarse Bu will not appear during the cooling from 800° to 500° C. at an average cooling rate from 1.5 to 30° C./s, and the cross-like fine acicular ferrite is formed with the Ti oxide precipitates in the austenite grains, serving as the transformation nuclei. The structures after the simulating thermal cycle of the present invention and the comparison steel are shown in FIGS. 1(*a*) and 1 (*b*).

As shown in Table 1, the steels of the present invention show markedly excellent Charpy notch toughness similarly after any of the various simulating thermal cycles as compared with the comparative steel.

In Table 2, the results of tests for deforming the cold cracks in the steels according to the present invention are shown in comparison with the conventional steel. The tests were conducted according to the "Tekken-type y-slit test defined in JIS Z3158(1966)" in which the samples were held at the temperatures as shown in the table and welded in the atmosphere of 72 to 78% humidity at an ambient temperature of 20° C.

As shown in Table 2, the cold crack appeared even at the preheating temperature of 50° C. in the comparative steel, while in the present invention no crack appeared even at the material temperature of 0° C. Since the compositions of the present steels and the comparative steel are substantially same, the difference in the resistance to the cold cracking is considered to be attributable to the difference in the transformation structure of the HAZ. Thus the HAZ structure of the steels of the present invention is composed of "fine bainite structure" consisting of Widmannstätten ferrite plates, whereas the HAZ structure of the comparative steel is a structure mixed with coarse Bu and mixture of bainite and island-like martensite, through which the crack runs.

EXAMPLE 2

Table 3 shows the transformation structures and results of COD tests of various steels as-cast or as-hot-rolled which are prepared by adding Ti to molten steels having various combinations of Al and dissolved oxygen contents and casting or further hot rolling.

In Table 3, the steels A, B, F, G, H, I, J and K are within the scope of the present invention, while the steels C, D and E are comparative steels. According to the present invention, Ti is added to the molten steels containing not more than 0.007% [Al] and not more than 0.020% dissolved [O] prior to the Ti addition, and when these steels are subjected to the simulating thermal cycle (800 to 500° C., average cooling rate 12° C./sec.), the fine bainite structure composed of fine Widmannstätten ferrite plates, which is the main feature of the present steel, is formed. In the portion where the Widmannstätten ferrite plates cross each other, fine particles of Ti oxides mainly composed of $Ti_2O_3$ are seen. The amount of [Al] existing prior to the addition of Ti to the molten heats of the above steels is not the aluminum added as the deoxidizer, but the aluminum coming from the ferro-alloys and the refractories and so on.

In the steel C, although the amount of [Al] in the molten steel prior to the addition of Ti is within the scope of the present invention, the amounts of dissolved O and Ti added are excessive so that the resultant Ti precipitates are in the form of coarse oxides having an unclear crystal structure, and in their transformation structures after the simulating thermal cycle, FSP, coarse Bu and coarse ingrain ferrite are formed. The steels D and E are the so-called Si-Al killed steel, and the addition of Ti to these steels is nothing more than the conventional TiN treatment. Therefore, the transformation structures of these steels after the simulating thermal cycle are quite susceptible to the formation of FSP, coarse Bu and additionally bainite, and island-like martensite. These undesired transformation structures are considered to be attributed to the fact that the Al existing in the molten steel prior to the addition of Ti prevents the formation of the desired Ti oxides which is the basic technical essence of the present invention.

Further, with the application of a simulating thermal cycle corresponding to one which most severely embrittles the HAZ in actual welding practices (heating to a maximum temperature of not lower than 1350° C. in the first pass and heating to the temperature range from $Ac_1$ to $Ac_3$ in the subsequent pass) the steels of the present invention will produce a microstructure composed of Bu partially mixed with cementite, whereas the comparative steels will produce a structure in which many coarse Bu and additionally island-like martensites appear at the grain boundaries of the original austenite grains.

Measurements of the COD value at Tδc 0.25 mm (the transient temperature at which the δc of COD is 0.25 mm) of the reproduced HAZ of the present steels and the comparative steels reveal that the present steels show satisfactory values while all of the comparative steels show poor values. In the case of the comparative steels, the island-like martensites markedly appear during the second heating of the thermal cycle and thereby the COD value is greatly lowered, while in the present invention, the fine bainite is produced in the first heating so that even though the cementite is formed in the second heating, the formation of island-like martensite is very little hence the COD value is not deteriorated.

On the basis of the results of the above experiments, it is preferable in the present invention that no Al is added to the molten steel prior to the addition of Ti, in principle, and the Al coming into the molten steel from refractories and ferro-alloys is maintained in amounts not higher than 0.007% at the time of addition of Ti, and the contents of Al, Ti and O in the steel after casting are maintained respectively not more than 0.007% Al, 0.003 to 0.050% Ti and 0.0010 to 0.0100% O.

The steels according to the present invention, when applied with welding, produce a microstructure in the HAZ which is far finer than that obtainable by the conventional Al-Si killed steels treated with TiN for improving the toughness of the HAZ and provides the following commercial advantages.

(a) The Charpy notch toughness of the HAZ (particularly in the case of large heat-input welding) can be markedly improved.

(b) The COD value of the HAZ is enhanced and stabilized.

(c) Even in the case of steels which are not positively lowered in the carbon content, $C_{eq}$, $P_{cm}$ etc., the resistance to cold cracking of the welded structure can be improved without hardening the HAZ.

By virtue of the above technical advantages, the present invention provides steel materials which can be advantageously used in marine structures, ships, various tanks, penstocks, pressure vessels, bridges, line pipes and other steel structures without necessity of preheating or after-heating for welding, yet assuring safety against the brittle fractures in welded structures.

TABLE 1

| | | | Production Conditions and Properties | |
|---|---|---|---|---|
| | | | Present Steel | Comparative Steel (Al—Si killed steel) |
| Production Conditions | Prior to Ti Addition [O] | | 0.0097% | 0.0028% |
| | Prior to Ti Addition [Al] | | 0.002% | 0.037% |
| | Prior to Ti Addition [Si] | | 0.04% | 0.30% |
| | Casting Method | | Casting | Casting |
| | Rolling Method | | Hot rolling-Annealing | Hot rolling-Annealing |
| | Shape of Products | | Thick Plate | Thick Plate |
| Properties | Steel Composition (wt %) | C | 0.13 | 0.13 |
| | | Si | 0.23 | 0.28 |
| | | Mn | 1.48 | 1.46 |
| | | P | 0.009 | 0.007 |
| | | S | 0.0023 | 0.0015 |
| | | Al | 0.002 | 0.035 |
| | | Ti | 0.013 | 0.012 |
| | | O | 0.0065 | 0.0028 |
| | | N | 0.0016 | 0.0035 |
| | Ti Precipitates having particle sizes not larger than 10 μm | | Mainly composed of $Ti_2O_3$ mixed with some TiO | TiN |
| | Amount (Weight %) | | 0.018 | 0.014 |
| Average Cool- | °C/s | Structure | Grain Boundary Ferrite + | Grain Boundary Ferrite + |

TABLE 1-continued

| | | | Production Conditions and Properties | |
|---|---|---|---|---|
| | | | Present Steel | Comparative Steel (Al—Si killed steel) |
| ing Rates From 800 to 500° C. after Simulating Thermal Cycle (Max. Temp. ≧1400° C.) and Resultant Structures and vTrs | 1.5 | | Fine Bainite | FSP + Coarse Bu + Pearlite |
| | | vTrs | −15° C. | +40° C. |
| | 3 | Structure | Grain Boundary Ferrite + Fine Bainite | Grain Boundary Ferrite + FSP + Coarse Bu |
| | | vTrs | −35° C. | +30° C. |
| | 7 | Structure | Fine Bainite | FSP + Coarse Bu + Bainite + Island-like Martensite |
| | | vTrs | −65° C. | +5° C. |
| | 15 | Structure | Fine Bainite | Bainite + Island-like Martensite + Martensite |
| | | vTrs | −25° C. | +25° C. |
| | 30 | Structure | Fine Bainite | Bainite + Island-like Martensite + Martensite |
| | | vTrs | −30° C. | +40° C. |

TABLE 2

| | | | Cold Cracking Tendency | |
|---|---|---|---|---|
| | | | Present Steel | Comparative Steel (Al—Si killed steel) |
| No-preheating | (0° C.) | Surface Crack | Cracking Ratio 0% | Cracking Ratio 85% |
| Ambient Temperature | 20° C. | Route Crack | 0 | 100 |
| Humidity | 75% | Section Crack | 0 | 100 |
| Preheating | 25° C. | Surface Crack | 0 | 5 |
| Ambient Temperature | 20° C. | Route Crack | 0 | 25 |
| Humidity | 75% | Section Crack | 0 | 10 |
| Preheating | 50° C. | Surface Crack | 0 | 0 |
| Ambient Temperature | 20° C. | Route Crack | 0 | 5 |
| Humidity | 78% | Section Crack | 0 | 5 |
| Preheating | 100° C. | Surface Crack | 0 | 0 |
| Ambient Temperature | 20° C. | Route Crack | 0 | 0 |
| Humidity | 72% | Section Crack | 0 | 0 |
| Preheating | 150° C. | Surface Crack | 0 | 0 |
| Ambient Temperature | 20° C. | Route Crack | 0 | 0 |
| Humidity | 74% | Section Crack | 0 | 0 |

Remark 1. Test Method: Tekken-type y-slit test defined in JIS Z3158-'66
Remark 2.
Welding Condition: 170 A × 24 V, 15 cm/min.
Welding Electrode: Low-hydrogen Electrode JIS D 5016

TABLE 3 (1)

| | | | Molten Steel Conditions at the Time of Ti Addition and Ti Precipitates | | | | | | | | | | |
|---|---|---|---|---|---|---|---|---|---|---|---|---|---|
| | | | Present Method A | Present Method B | Comparative Method C | Comparative Method D | Comparative Method E | Present Method F | Present Method G | Present Method H | Present Method I | Present Method J | Present Method K |
| Production Conditions | Al Content in Molten Steel Prior to Ti Addition | | 0.002% | 0.001% | 0.001% | 0.025% | 0.028% | 0.002% | 0.005% | 0.003% | 0.004% | 0.004% | 0.002% |
| | Si Content in Molten Steel Prior to Ti Addition | | 0.05 | 0.04 | 0.04 | 0.40 | 0.34 | 0.03 | 0.05 | 0.04 | 0.02 | 0.04 | 0.05 |
| | [O] Content in Molten Steel Prior to Ti Addition | | 0.0125 | 0.0195 | 0.0250 | 0.0068 | 0.0025 | 0.0092 | 0.0038 | 0.0065 | 0.0053 | 0.0048 | 0.0072 |
| | Casting Method | | Continuous Casting | Same as A | Ingot Making | Ingot Making | Continuous Casting | Same as E | Same as E | Continuous Casting | Same as H | Ingot Making | Centrifugal Casting |
| | Rolling Method | | Hot Rolling-Annealing | Same as A | No-Rolling | No-Rolling | Hot Rolling-Annealing | Hot Rolling-QT | Controlled Cooling | Controlled Rolling | Controlled Rolling-DQT | Hot Rolling-Annealing | As-Cast |
| | Shape of Product | | Thick Plate | Same as A | Cast Plate | Cast Plate | Thick Plate | Thick Plate | Thick Plate | Thick Plate | Thick Plate | Section Steel | Pipe |
| Properties | Steel Composition (wt %) | C | 0.132 | 0.101 | 0.126 | 0.156 | 0.130 | 0.095 | 0.062 | 0.126 | 0.108 | 0.186 | 0.112 |
| | | Si | 0.23 | 0.21 | 0.35 | 0.41 | 0.32 | 0.04 | 0.05 | 0.04 | 0.02 | 0.29 | 0.42 |
| | | Mn | 1.48 | 0.89 | 1.32 | 1.52 | 1.46 | 1.40 | 1.18 | 1.41 | 1.27 | 1.43 | 1.46 |
| | | P | 0.009 | 0.007 | 0.005 | 0.004 | 0.007 | 0.006 | 0.006 | 0.016 | 0.008 | 0.023 | 0.004 |
| | | S | 0.002 | 0.004 | 0.001 | 0.001 | 0.002 | 0.002 | 0.001 | 0.0043 | 0.0015 | 0.007 | 0.003 |
| | | Al | 0.002 | <0.001 | 0.001 | 0.023 | 0.035 | <0.001 | 0.003 | 0.007 | 0.004 | 0.003 | 0.002 |
| | | Ti | 0.013 | 0.023 | 0.065 | 0.016 | 0.012 | 0.018 | 0.011 | 0.031 | 0.027 | 0.018 | 0.016 |
| | | O | 0.0065 | 0.0075 | 0.0110 | 0.0049 | 0.0028 | 0.0067 | 0.0037 | 0.0020 | 0.0047 | 0.0059 | 0.0048 |
| | | N | 0.0016 | 0.0019 | 0.0021 | 0.0020 | 0.0035 | 0.0008 | 0.0022 | 0.0025 | 0.0020 | 0.0017 | 0.0023 |
| | | Others | none | Ni: 1.40<br>Cr: 0.32<br>Mo: 0.24<br>B: 0.0013 | none | Cu: 0.32<br>Ni: 0.19 | none | Cu: 0.35<br>Ni: 0.30<br>Mo: 0.15 | Ni: 1.55<br>Mo: 0.11 | Nb: 0.026<br>B: 0.009 | Cr: 0.17<br>Nb: 0.032<br>V: 0.042<br>B: 0.0012 | none | Cu: 1.14<br>Ni: 0.72<br>Zr: 0.04<br>Ca: 0.0011 |
| | Ti Precipitates having Particle Sizes not larger than 10 μm | | Mainly Composed of $Ti_2O_3$ mixed with some TiO | Same as A | Coarse Oxides (3 μm) having Unclear Crystal Structure | TiN | TiN | Mainly Composed of $Ti_2O_3$ mixed with some TiO | Same as F | Mainly Composed of $Ti_2O_3$ mixed with some TiO | Same as H | Same as H | Same as H |
| | Amount (wt %) | | 0.022 | 0.031 | 0.073 | 0.019 | 0.014 | 0.022 | 0.012 | 0.008 | 0.033 | 0.024 | 0.021 |

TABLE 3 (2)

| Heat Cycle | COD | Present Steel A | Present Steel B | Comparative Steel C | Comparative Steel D | Comparative Steel E |
|---|---|---|---|---|---|---|
| | | Structures after simulating thermal cycle | | | | |
| PT1400° C. 800 ~500° C. Average Cooling Rate 12° C./sec. | Features of Structures | Fine bainite structure composed of fine Widmannstatten ferrite plates | Same as A | FSP + Coarse Bu + Coarse In-grain Ferrite | FSP + Coarse Bu + Bainite + Island-like Martensite | Same as D |
| | Tδc0.25 mm (°C.) | −10 | −15 | 10 | 30 | +5 |
| PT1400° C. 800 ~500° C. Average Cooling Rate 12° C./sec. + PT800° C. 800 ~500° C. Average Cooling Rate 12° C./sec. | Features of Stuctures | Bu + Bainite mixed partially with cementite | Same as A | FSP + remarkable island-like martensite | Same as C | Same as D |
| | Tδc0.25 mm (°C.) | −5 | −10 | +40 | +50 | +30 |
| | Tδc0.25 mm (°C.) | −5 | −10 | +40 | +50 | +30 |

| Heat Cycle | COD | Present Steel F | Present Steel G | Present Steel H | Present Steel I | Present Steel J | Present Steel K |
|---|---|---|---|---|---|---|---|
| | | Steel | | | | | |
| PT1400° C. 800 ~500° C. Average Cooling Rate 12° C./sec. | Features of Structures | Fine bainite structure composed of fine Widmannstatten ferrite plates | Same as F | Same as G | Same as H | Same as I | Same as J |
| | Tδc0.25 mm (°C.) | −20 | −50 | −15 | −5 | −10 | −15 |
| PT1400° C. 800 ~500° C. Average Cooling Rate 12° C./sec. + PT800° C. 800 ~500° C. Average Cooling Rate 12° C./sec. | Features of Structures | Bu + Bainite mixed partially with cementite | Bainite mixed partially with cementite | Bu + Bainite mixed partially with cementite | Same as H | Same as I | Same as J |
| | Tδc0.25 mm (°C.) | −10 | −40 | −10 | +10 | −5 | −10 |

We claim:

1. A process for producing weldable structural steel materials which are characterized by a fine bainite microstructure and show excellent toughness in the HAZ, which comprises adding titanium to a molten steel containing not more than 0.020% of dissolved oxygen and not more than 0.007% of aluminum to deoxide the molten steel, and casting the molten steel thus deoxidized, the cast product thus obtained containing:

C: 0.001 to 0.300%
Mn: 0.4 to 2.0%
P: 0.025% max.
S: 0.025% max.
Al: 0.007% max.
Ti: 0.003 to 0.050%
O: 0.0010 to 0.0100%
Balance: iron and unavoidable impurities and containing 0.002 to 0.100% of oxide inclusion having a complex grain phase composed of one or more Ti oxides having a particle size of not larger than 10 μm.

2. A process according to claim 1 which further comprises rolling the cast product.

3. A process according to claim 1 wherein the materials consist essentially of the stated materials and wherein and the titanium oxide includes at least one member of the group consisting of TiO and $Ti_2O_3$.

4. A weldable structural steel material which is characterized by a fine bainite microstructure and is used for welded structures comprising;

C: 0.001 to 0.300%
Mn: 0.4 to 2.0%
P: 0.025% max.
S: 0.025% max.
Al: 0.007% max.
Ti: 0.003 to 0.050%
O: 0.0010 to 0.0100%
Balance: iron and unavoidable impurities and containing 0.002 to 0.100% of oxide inclusion having a complex grain phase composed of one or more Ti oxides having a particle size of not larger than 10 μm.

5. Weldable structural steel material according to claim 4 in which the steel material is in an as-cast.

6. Weldable structural steel material according to claim 4 in which the steel material is in an as-rolled condition.

7. A weldable structural steel material according to claim 4 wherein the materials consist essentially of the stated materials and the titanium oxide includes at least one member of the group consisting of TiO and $Ti_2O_3$.

8. A process for producing weldable structural steel materials which are characteristized by a fine bainite structure and show excellent toughness in the HAZ, which comprises adding titanium to a molten steel containing not more than 0.020% of dissolved oxygen and not more than 0.007% of aluminum to deoxide the molten steel, and casting the molten steel thus deoxidized, the cast product thus obtained containing:

C: 0.001 to 0.300%
Mn: 0.4 to 2.0%
P: 0.025% max.
S: 0.025% max.
Al: 0.007% max.
Ti: 0.003 to 0.050%
O: 0.0010 to 0.0100% and also at least one of Si, Cu, Ni, Cr, Mo, Nb, V, B,Zr, Ta, W, Co and Ca in an amount:
Si: 0.8% max.
Cu: 1.5% max.
Ni: 10% max.
Cr: 1% max.
Mo: 1% max.
Nb: 0.2% max.
V: 0.5% max.
B: 0.005% max.
Zn: 0.1% max.
Ta: 0.1% max.
W: 0.1% max.
Co: 0.1% max.
Ca: 0.002% max.
Balance: iron and unavoidable impurities and containing 0.002 to 0.100% of oxide inclusion having a complex grain phase composed of one or more Ti oxides having a particle size of not larger than 10 μm.

9. A process according to claim 8 which further comprises rolling the cast product.

10. A process according to claim 8 wherein the materials consist essentially of the stated materials and wherein the carbon content is 0.13 to 0.300% and the titanium oxide includes at least one member of the group consisting of Ti and $Ti_2O_3$.

11. A weldable structural steel material which is characterized by fine bainite microstructure and is used for welded structures comprising:

C: 0.002 to 0.300%
Mn: 0.4 to 2.0%
P: 0.025% max.
S: 0.25% max.
Al: 0.007% max.
Ti: 0.003 to 0.050%
O: 0.00100 to 0.0100%
and also at least one of Si, Cu, Ni, Cr, Mo, Nb, V, B, Zr, Ta, W, Co and Ca in an amount:
Si: 0.8% max.
Cu: 1.5% max.
Cr: 1% max.
Mo: 1% max.
Nb: 0.2% max.
V: 0.5% max.
B: 0.005% max
Zn: 0.1% max.
Ta: 0.1% max.
W: 0.1% max.
Co: 0.1% max.
Ca: 0.002% max.
Balance: iron and unavoidable impurities and containing 0.002 to 0.100% of oxide inclusion having a complex grain phase composed of one or more Ti oxides having a particle size of not larger than 10 μm.

12. A weldable structural steel material according to claim 11 in which the steel material is in an as-cast condition.

13. A weldable structural steel material according to claim 11 in which the steel material is in an as-rolled condition.

14. A weldable structural steel material according to claim 11 wherein the materials consist essentially of the stated materials and and the titanium oxide includes at least one member of the group consisting of TiO and $Ti_2O_3$.

* * * * *